United States Patent [19]

Wardy

[11] Patent Number: 4,687,414

[45] Date of Patent: Aug. 18, 1987

[54] OUTDOOR FAN BACKPACK

[76] Inventor: Willie J. Wardy, Rte. 3, Box 464A, Effingham, S.C. 29541

[21] Appl. No.: 836,491

[22] Filed: Mar. 5, 1986

[51] Int. Cl.[4] ..... F04D 29/64

[52] U.S. Cl. ..... 416/63; 416/146 R; 416/247 R; 224/153

[58] Field of Search ..... 416/63, 54, 146 R, 246; 224/153–156

[56] References Cited

U.S. PATENT DOCUMENTS

| | | | |
|---|---|---|---|
| 295,982 | 4/1884 | Conwell . | |
| 626,209 | 5/1899 | Nichols et al. | 416/63 |
| 1,220,628 | 3/1917 | Hauser | 416/146 R |
| 1,254,042 | 1/1918 | Howe | 416/63 X |
| 1,434,609 | 11/1922 | Greensaft | 416/146 R X |
| 1,473,045 | 11/1923 | Puttaert et al. . | |
| 2,495,265 | 1/1950 | Krogman | 240/2 |
| 2,555,871 | 6/1951 | Caggiano | 240/59 |
| 3,045,900 | 7/1962 | Zekendorf | 416/146 R X |
| 3,168,748 | 2/1965 | Limberg | 2/171.3 |
| 3,177,881 | 4/1965 | Covington | 135/16 |
| 3,295,886 | 1/1967 | Goldmerstein | 416/146 R X |
| 3,353,191 | 11/1967 | Dahly | 2/171.3 |
| 3,401,874 | 9/1968 | Covington | 416/146 R X |
| 3,491,374 | 1/1970 | Frangos | 2/171.3 |
| 3,576,376 | 4/1971 | Steeg | 416/63 |
| 3,813,696 | 6/1974 | Yeager | 2/171.3 |
| 4,037,763 | 7/1977 | Turchen | 224/153 |
| 4,114,788 | 9/1978 | Zufich | 224/153 |
| 4,286,739 | 9/1981 | Silcott et al. | 224/153 X |

FOREIGN PATENT DOCUMENTS

| | | | |
|---|---|---|---|
| 607588 | 7/1926 | France | 416/63 |
| 1326416 | 4/1963 | France | 416/63 |
| 85591 | 7/1981 | Japan | 416/246 |
| 223834 | 10/1942 | Switzerland | 416/146 R |
| 557890 | 12/1943 | United Kingdom | 416/63 |
| 633956 | 12/1949 | United Kingdom | 416/63 |

OTHER PUBLICATIONS

The Best of Camping World-Catalogue (back-page-Fall/Winter 1984).

*Primary Examiner*—Everette A. Powell, Jr.
*Attorney, Agent, or Firm*—Benoni O. Reynolds

[57] ABSTRACT

An outdoor fan backpack for cooling the head of an individual while he or she is working outdoors in the hot sun. A small, quiet, lightweight, electrical fan, is supported just above and to the rear of the head by a mounting plate and guard attached between two vertically disposed and adjustable tubular members which are strapped to the back of the individual by shoulder straps and a belt. The electrical fan is operated by a control switch and a battery pack mounted on the belt.

1 Claim, 4 Drawing Figures

OUTDOOR FAN BACKPACK

BACKGROUND OF THE INVENTION (1) Field of the Invention:

This invention relates to apparatus for cooling the head of a worker who must perform his or her tasks outdoors and in the heat of the sun.

(2) Description of Prior Art:

Most workers who must perform their tasks outdoors and in the sun have not had much success in keeping cool. In the absence of a natural breeze, shading devices or hand held, manually operated fans have been the major sources of protection from the heat of the sun.

Regardless of the cooling device employed, freedom to use ones hands has posed a limitation as to the configuration of any self-transported cooling device. Where only one hand needed to be free, a flashlight configuration, such as the Portable Electric Fan of Puttaert et al (1923), was a feasible solution. Another approach was the combining of an umbrella and a motor driven cooling fan, the latter mounted under the crown of the umbrella (Covington, 1965).

The most common approach for hands-free operation has centered on hats or helmets as the support element for small, circulating fans. Limberg's Hat With Power Cooling featured a battery operated, self contained fan, mounted on the visor of the hat. Sweatbands of sponge-like material, to hold water, added the cooling effect of evaporating water. Another version of the technique is found in the Headgear of Frangos (1970, where propellers, operated by worm gears, were mounted atop a perforated helmet. The oscillating propellers were actuated by a remote power supply in the shape of a flashlight case. The most recent art of this type is the Power Ventilated Helmet of Yeager (1974) where a reversible exhaust fan is mounted in the crown of the helmet. Dahly, with a similar helmet in 1967, introduced a solar cell as a source of electrical power.

It is noted that none of these power cooled hats, helmets or other types of headgear have been a commercial success. These headgear have utilized motor-driven fans and batteries mounted to the head piece. The motors are mounted in a fixed position and drive air into or air from the interior of the helmets. Although providing for a flow of cooling air over the head of the wearer, these helmets and hats are relatively heavy and uncomfortable to wear. Also, because of the fixed mounting of the fan, the air flow is localized only to certain portions of the head. The present invention overcomes most of these drawbacks and provides flexibility in directing the flow of the air. Prior art known to this inventor includes the following U.S. Pat. Nos.:

295,982, 1/1884, Conwell;
1,473,045, 11/1923, Puttaert et al;
2,495,265, 1/1950, Krogman;
2,555,871, 6/1951, Caggiano;
3,168,748, 2/1965, Limberg;
3,177,881, 4/1965, Covington;
3,353,191, 11/1967, Dahly;
3,491,374, 1/1970, Frangos;
3,813,696, 4/1971, Steeg;
3,813,696, 6/1974, Yeager;

BRIEF SUMMARY OF INVENTION

The present invention is an outdoor fan backpack which creates a breeze in and about the head of an individual working outdoors in the heat of the sun.

According to the preferred embodiment of this inventior., the backpack has a small, quiet, lightweight, electrical fan which is supported in a position slightly above and to the rear of the individual wearing the backpack. The electrical fan is held in that position by a mounting plate and guard which are attached between the upper portions of two vertically disposed tubular members which are adjustable to the height of the individual wearing the backpack. These tubular members are curved slightly inward at the top to conform to the shoulders of the individual wearer and to properly position the electrical fan. The two tubular members are respectively secured to a belt and to parallel disposed shoulder straps at a point immediately behind the shoulders of the individual wearer. The electrical fan is operated by low voltage direct current supplied by a battery pack mounted on the belt at the waist of the individual wearer. A control switch, also mounted on the belt, is interconnected electrically to the electrical fan, and is used to turn the fan off and on and to regulate its speed by controlling the flow of the direct current to the electrical fan.

OBJECTIVES OF THE INVENTION

The objectives of the present invention are to provide a portable outdoor fan which is:

(1) capable of creating a gentle breeze in and about the head of an individual working with his hands in the hot sun;

(2) small, quiet, lightweight, and easily carried on the person of the individual worker;

(3) essentially hands-free in its operation and does hot impede the arm movements of the wearer;

(4) self contained in its power source and easy to turn off and on or otherwise control its speed;

(5) more simple and inexpensive to manufacture than devices known in the prior art to perform a similar function;

(6) constructed with fewer moving parts to provide more reliable operation and less maintenance under heavy usage conditions;

Other objectives and advantages of the present invention will be apparent during the course of the following detailed description.

DETAILED DESCRIPTION OF THE PREFERRED EMBODIMENT OF THE INVENTION

Figure 1:
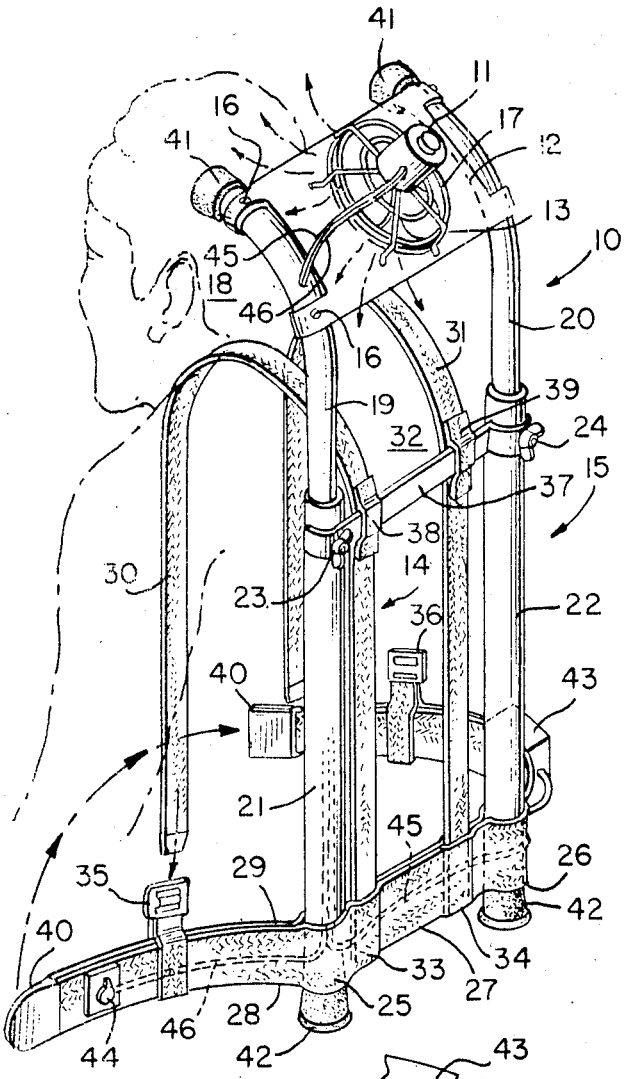
FIG. 1 is a perspective view from the left rear of an Outdoor Fan Backpack constructed in accordance with the principles of the present invention, showing the electrical fan, the mounting plate, guard and the two tubular members.

The outdoor fan backpack is a lightweight, compact unit to be worn on the back, which can be easily and quickly slipped over the arms and shoulders of an individual who is working outdoors in the heat of the sun. Throughout the following detailed description of the present invention, like reference numerals are used to denote like parts disclosed in the accompanying drawings, FIGS. 1–4.

As shown in FIG. 1, the outdoor fan backpack, shown generally at reference numeral 10, has a fan means to create a breeze in and about the head of the individual wearing the backpack. Fan means is a small, quiet, lightweight, electrical fan 11, operated by low voltage direct current. As further shown in FIGS. 1 and 2, support means is provided to hold electrical fan 11 in a position slightly above and to the rear of the head of the individual wearing outdoor fan backpack 10. Support means is a mounting plate 12 and a guard 13, attached between the upper portions of two vertically disposed and adjustable tubular members, shown generally at reference numerals 14 and 15, respectively.

Mounting plate 12 is made of flat, light metal, such as aluminum, and is attached to tubular members 14 and 15, which are made of similar metal, by four metal screws 16. Mounting plate 12 has a circular hole 17 cut in the center of said mounting plate 12 to accommodate electrical fan 11 and its guard 13. Guard 13 is welded to the rear of mounting plate 12, surrounding circular hole 17 and completely enclosing electrical fan 11 as a safety measure. Guard 13 also serves to position electrical fan 11 in the center of circular hole 17.

Tubular members 14 and 15 are curved slightly inward at their tops, shown generally at reference numeral 18, to conform to the shoulders of the individual wearing outdoor fan backpack 10. The diameter of upper portions 19 and 20, respectively, of tubular members 14 and 15, is slightly smaller than the diameter of lower portions 21 and 22 of the same tubular members 14 and 15. This relationship permits upper portions 19 and 20 to easily telescope into lower portions 21 and 22. This structure provides adjustability to tubular members 14 and 15. Thumb screws 23 and 24, respectively, hold upper portions 19 and 20 in the position selected by the individual wearing outdoor fan backpack 10.

Tubular members 14 and 15 are secured at their bottoms 25 and 26, respectively, to belt 27 by being tightly sewn between outside layer 28 and inside layer 29 of said belt 27. Further, tubular members 14 and 15 are respectively secure to parallel disposed shoulder straps 30 and 31 at a point 32 immediately behind the shoulders of the individual wearing outdoor fan backpack 10. Shoulder straps 30 and 31 are made of narrow webbing or other water resistant material, sewn at their lower ends 33 and 34, respectively, to belt 27. When adjusted to the height of the individual wearer, shoulder straps 30 and 31 can be fastened in buckles 35 and 36, respectively, and slipped over the arms and shoulders of the individual wearer, as is the custom with other outdoor backpacks. Crosspiece 37 is made of lightweight metal and acts as a spacer between tubular members 14 and 15. Also, to maintain outdoor fan backpack 10 in an upright position, crosspiece 37 is secured to shoulder straps 30 and 31 by loops 38 and 39, respectively, which are sewn or otherwise affixed to said shoulder straps 30 and 31. Belt 27 is detachably secured to the waist of the individual wearer by buckle assembly 40. For further safety, tubular members 14 and 15 are capped at their upper and lower ends with rubber caps 41 and 42, respectively.

Figure 2:
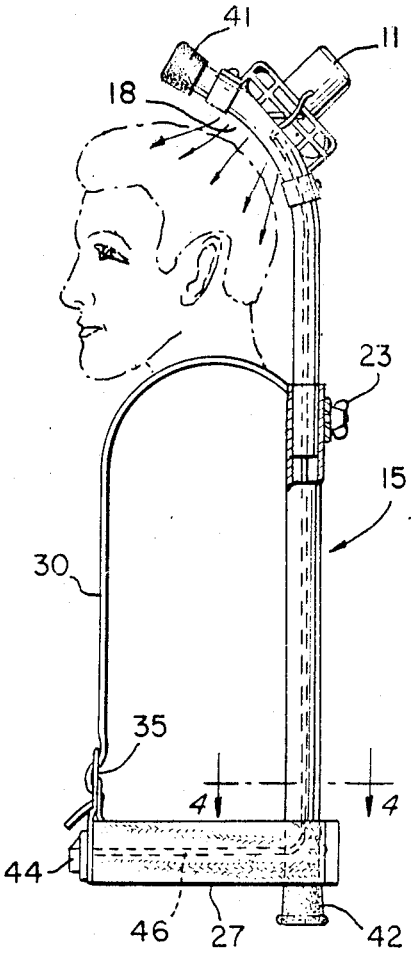
FIG. 2 is a fragmentary elevation view from the left side of the present invention, showing the positioning of the electrical fan in relation to the head of the individual wearing the backpack.
Figure 4:
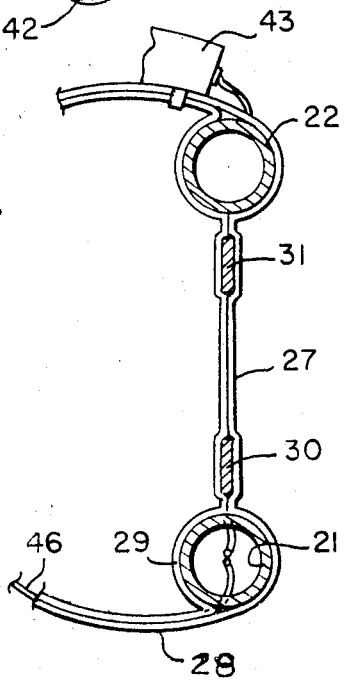
FIG. 4 is a fragmentary sectional view taken along line 4—4 of FIG. 2 from the direction of the arrows, showing how the two tubular members and the parallel disposed shoulder straps are secured to the belt.
Figure 3:
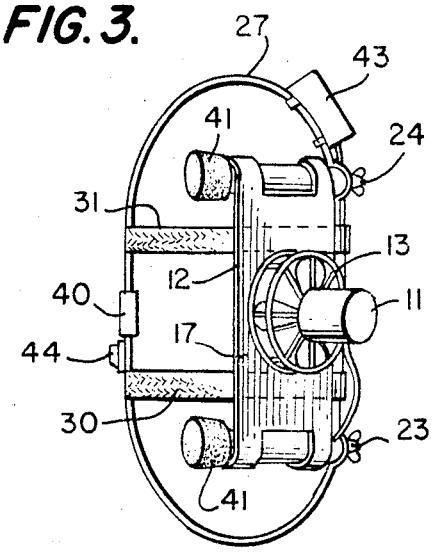
FIG. 3 is a plan view of the present invention, showing the mounting plate, guard and the electrical fan.

As shown in dotted lines, in FIGS. 1 and 2, outdoor fan backpack 10 is provided with operating means to turn electrical fan 11 off and on and to regulate its speed. Operating means is a battery pack 43 and a control switch 44, mounted on belt 27, and interconnected with electrical fan 11 by wires 45 and 46, so that control switch 44 controls the flow of low voltage direct current to said electrical fan 11. Wire 45 runs from one terminal of electrical fan 11 directly to battery pack 43. Wire 46 runs from the second terminal of electrical fan 11, through control switch 44 to battery pack 43. The individual wearing outdoor fan backpack 10 need only turn control switch 44 to the "on" position and rotate the rheostat, encased in control switch 44, to vary the flow of current to, and thus the speed of, electrical fan 11.

I claim:

1. An outdoor fan backpack comprising:

a small, quiet, lightweight, electrical fan, operated by low voltage direct current, to create a breeze in and about the head of the individual wearing said backpack, and a mounting plate and guard, attached between the upper portions of two vertically disposed and adjustable tubular members, which members are curved slightly inward at their tops to conform to the shoulders of said individual and are respectively secured at their bottoms to a belt and to parallel disposed shoulder straps at a point immediately behind the shoulders of said individual, to hold said electrical fan in a position slightly above and to the rear of the head of said individual, and a battery pack and a control switch mounted on said belt and electrically interconnected with said electrical fan so that said control switch controls the flow of low voltage direct current to said electrical fan, to turn said electrical fan off and on and to regulate its speed.

* * * * *